US007677986B2

(12) United States Patent
Ochi

(10) Patent No.: US 7,677,986 B2
(45) Date of Patent: Mar. 16, 2010

(54) SHIFTING GUIDES FOR GUTTER BALL PREVENTION ON A BOWLING ALLEY

(75) Inventor: Yasushi Ochi, Izumisano (JP)

(73) Assignee: BLD Oriental, Ltd., Osaka (JP)

( * ) Notice: Subject to any disclaimer, the term of this patent is extended or adjusted under 35 U.S.C. 154(b) by 672 days.

(21) Appl. No.: 11/569,593

(22) PCT Filed: May 19, 2005

(86) PCT No.: PCT/JP2005/009140

§ 371 (c)(1),
(2), (4) Date: Nov. 26, 2006

(87) PCT Pub. No.: WO2005/115568

PCT Pub. Date: Dec. 8, 2005

(65) Prior Publication Data

US 2009/0264213 A1 Oct. 22, 2009

(30) Foreign Application Priority Data

May 26, 2004 (JP) ..... 2004-155999

(51) Int. Cl.
*A63D 5/00* (2006.01)

(52) U.S. Cl. ..... 473/55; 473/113

(58) Field of Classification Search ..... 473/55, 473/106, 109, 113
See application file for complete search history.

(56) References Cited

U.S. PATENT DOCUMENTS 3,046,012 A 7/1962 Mark
3,111,315 A * 11/1963 Vermeulen ..... 473/109
3,401,933 A * 9/1968 Conklin et al. ..... 473/109
4,330,122 A 5/1982 Sheinberg et al.
4,900,024 A * 2/1990 Chandler et al. ..... 473/109
5,207,422 A * 5/1993 Beene ..... 473/54
5,304,097 A * 4/1994 Duff ..... 473/113
5,322,476 A * 6/1994 Wortman ..... 473/113
5,358,448 A * 10/1994 Stephens ..... 473/113
5,380,251 A * 1/1995 Heddon ..... 473/109
5,405,295 A * 4/1995 Lord ..... 473/55
5,417,616 A * 5/1995 Widrick ..... 473/113

(Continued)

OTHER PUBLICATIONS

European Search Report dated Nov. 27, 2007, issued in corresponding European Patent Application No. 05741558.

*Primary Examiner*—William M Pierce
(74) *Attorney, Agent, or Firm*—Westerman, Hattori, Daniels & Adrian, LLP

(57) ABSTRACT

Bowling game apparatus allowing children to get strikes and spares for a high score. Two guides (10) are provided longitudinally along lane (3); two first retainers (15) are arranged outside the end of lane (3) near approach (2) for retaining first ends of the guides (10); two second retainers (20) for retaining the second ends of the guides (10) are provided over lane (3) between first retainers (15) and pins (5), and allow, as driven by a second-retainer drive unit, the guide second-end retaining portions of the second retainers (20) to shift between a guide position and a retract position apart from the guide position. The guides (10) diagonally intersect the longitudinal direction of the lane (3), where they come into contact with the height-wise center of a ball rolling down the lane (3) ball when the second-end retaining portions of the second retainers (20) are in the guide position.

16 Claims, 12 Drawing Sheets

U.S. PATENT DOCUMENTS 5,435,788 A * 7/1995 Duff ..... 473/113
RE35,232 E * 5/1996 Stephens ..... 473/55
5,564,986 A * 10/1996 Gretzky et al. ..... 273/113
5,681,224 A * 10/1997 Higashi ..... 473/109
5,800,274 A * 9/1998 Widrick et al. ..... 473/54
5,800,275 A * 9/1998 Gretzky et al. ..... 473/113
6,402,629 B1 * 6/2002 Heddon ..... 473/55
6,988,953 B2 * 1/2006 Kuoppa et al. ..... 473/113
7,070,510 B2 * 7/2006 Heddon ..... 473/55

* cited by examiner

SHIFTING GUIDES FOR GUTTER BALL PREVENTION ON A BOWLING ALLEY

TECHNICAL FIELD

The present invention relates to a bowling game apparatus in which a ball is rolled down a lane at the head of which a group of pins is arranged into place, and the pins are knocked down by the rolling ball for enjoyment.

BACKGROUND ART

Such bowling game apparatuses are configured with: an approach where players roll a ball; a lane extending from the approach and on which the ball rolls; a group of pins placed on the end of the lane opposite the approach; trough-like gutters that lie on either side of the lane and receive balls slipping off the lane. Players enjoy the game by competing with each other for a higher score that depends on the number of pins they knock down.

Of course, how many pins players are able to knock down depends on the direction of in which the ball is rolled—that is, players' scores are determined by which part of the arranged pins their balls strike, and on the players' skill at controlling the ball toward the center of the lane.

Being not yet fully developed physically, children are not able to control very well the direction in which the ball rolls, and consequently cannot hope for a high score, or as is likely to happen, they are able to knock down only a few pins because the ball always falls into the gutter. In such cases, children lose interest in the bowling game, and are left unable to enjoy household bowling outings with the object of interacting as a family.

In light of such considerations, various gutter-ball prevention apparatuses for preventing a bowled ball from falling into the gutter have been proposed to date. One of such apparatus is configured so that bars, which are placed along the both sides of the lane, simultaneously shift horizontally between a blocking position near the edge of the lane, where the bars prevent the ball from falling into the gutter, and a retract position near the edge of the gutters, where the bars shift from the blocking position. (Reference is made to Japanese Unexamined Pat. App. Pub. Nos. H7-155424, No. H9-84923 and No. H11-164931.)

In accordance with this gutter prevention apparatus, the bars shift into the blocking position when players, such as young children, unable to control a ball well bowl, and shift into the retract position when physically more developed adolescent players bowl.

Therefore, even if a ball rolled by juvenile players unable to control the direction of the rolling ball well rolls toward a gutter, the bars shift into the blocking position to prevent the ball from falling into the gutters and retain it on the lane, such that the ball runs into the pins and knocks down some of them as a result. In other words, even children are able to always knock down some of the pins and score.

The bars are shifted into the retract position when non-children players bowl, so that any gutter balls they bowl will fall directly into a gutter without being blocked.

The fact that this gutter prevention apparatus allows children to always knock down some of the pins and score encourages them to maintain interest in the game. Moreover, children are able to bowl along with adolescent and older players in the same lane, so that they are able to enjoy a household bowling outing to interact with as a family.

Additionally, the following apparatuses have been also proposed: an apparatus configured so that bars simultaneously shift vertically between a blocking position and a retract position lower than the blocking position (reference is made to Japanese Unexamined Pat. App. Pub. Nos. H10-151235 and 2002-65933), and an apparatus configured so that the gutters rotate toward the lane about axes paralleling the lane lengthwise (reference is made to Japanese Unexamined Pat. App. Pub. No. H10-506031). Both of these play the same role as that of the apparatus explained in the foregoing.

Patent Document 1: Japanese Unexamined Pat. App. Pub. No. H7-155424.

Patent Document 2: Japanese Unexamined Pat. App. Pub. No. H9-84923.

Patent Document 3: Japanese Unexamined Pat. App. Pub. No. H11-164931.

Patent Document 3: Japanese Unexamined Pat. App. Pub. No. H10-151235.

Patent Document 3: Japanese Unexamined Pat. App. Pub. No. 2002-65933.

Patent Document 3: Japanese Unexamined Pat. App. Pub. No. H10-506031.

DISCLOSURE OF INVENTION

Problem Invention is to Solve

Conventional bowling game apparatuses with gutter-ball prevention devices, however, are less than adequate to maintain children's interest in the bowling game.

For example, in the gutter prevention apparatus configured so that the bars shift into a blocking position, to the extent that strong rebounding power between the bars and the ball is not assured, even if a ball bowled by a player rolls toward a gutter and runs into one of the bars, the ball just rolls along the bar and strikes only a few pins positioned on the edge of the lane.

Even if the apparatus were configured to provide considerable rebounding power between the bars and a ball, it would not guarantee that many pins would always be knocked down, because the ball would roll in various directions after running into the bars. Although bowling game rules allow a player to bowl twice per frame to get a high score (a "spare") when the ball the player rolls second knocks down all the pins not knocked down by the ball the player rolls first, children have little chance of scoring high, because there is little probability of getting a spare with the gutter-ball prevention device constituted as explained above.

For this reason, the bowling game apparatus with this gutter prevention device is less than adequate for children who get bored easily, although compared with bowling facilities lacking the device, it has some advantage in helping maintain children's interest in a bowling game. In other words, to sustain the interest of children—who are curious, superiority-conscious and rich in a desire to improve themselves—in the game, there is a need for a situation in which they can raise their score to equal or better than the level of adolescent and older players, to let them compete at the same level as adolescent and older players.

The same holds true for the bowling apparatus configured so that the gutters rotate toward the lane.

The present invention is made in view of the fact explained in the foregoing and for the purpose of providing a bowling game apparatus allowing children unable to control the direction of in which a ball is bowled to get strikes and spares enough to get a high score.

Means for Resolving the Problem

The present invention for achieving the purpose involves in a bowling game apparatus furnished with at least an approach where players roll a ball, a lane extended from the approach and on which the ball rolled by the players rolls, several pins arranged and placed on an end of the lane opposite the approach, trough-like gutters that lies on the both sides of the lane and receives the ball falling from the lane, and the bowling apparatus having a configuration provided with two guides provided longitudinally with respect to the lane and composed of a wire-like, ropelike, belt-like, or rod-like constituent or a combination of these constituents, two first retainers placed on both outer sides near the end of the lane by the approach to retain first ends of the guides, two second retainers provided between the first retainers and the pins to retain second ends of the guides and provided so that the second end retaining parts shift between a guide position over the lane in the front of the pins viewed from the approach and a retract position apart from the guide position and a second retainer drive means allowing the second end retaining parts of the second retainers to shift between the retract and guide positions, and being configured so that the guides whose both ends are retained by the first and second retainers is allowed to intersect diagonally with a longitudinal direction of the lane viewed from above when the second end retaining part of the second retainers are at the guide position and contact with the ball rolling down the lane at the height-wise center of the ball so as to lead the ball contacted with the guides toward around a center of the pins.

According to this bowling game apparatus, when players are children who lacks the skills to control the direction of rolling a ball, the second end retaining parts of the second retainers shift into the guide position on the second retainer drive means. When the second end retaining parts are at this guide position over the lane and in front of the pins viewed from the approach, the guides, which first ends lie outside the end of the lane near the approach and second ends lie over the lane in front of the pins, intersect with the longitudinal direction of the lane viewed from the above and contact with the ball rolling down the lane at its height-wise center. As a result, the ball contacted with the guide is lead to around the center of the pins.

If players roll a ball with the second ends of each guides positioned at the guide position, the ball rolls down the lane between two guides toward the pins. Even if the ball rolls toward the gutters, it finally runs into around center of the pins because it contacts with the guides, which prevent it from falling into the gutters and lead it toward the pins before it reaches the gutters.

Which part of the pins a ball is guided into depends on the guide position. Setting the guide position to where a ball is guided to around the pocket or head of the pins allows children to easily get a strike.

When non-children players bowl, the second end retaining parts of the second retainers shift into the retract position on the second retainer drive means. This retract position is a position apart from the guide position, such as a position right or obliquely over the guide and a position horizontal to the guide position and near the gutters. In a word, it is where the guides stop preventing the ball from falling into the gutters when the second end retaining parts of second retainers shift into.

When the second end retaining parts are at the retract position, the ball directly falls into the gutters without being blocked even if it rolls toward the gutters. Therefore, players are able to enjoy a bowling game as with a conventional bowling game apparatus.

According to the bowling game apparatus involving in the present invention, when children bowl, the second end retaining parts of the second retainers shift into the guide position to allow the guides to prevent the ball from falling into the gutters and guide it to the center of the pins even if the ball rolls toward the gutters. Therefore, even children unable to control the direction of rolling a ball well are able to always knock down lots of pins and to sometimes get a strike and a spare.

On the other hand, when non-children players bowl, the second end retaining parts of the second retainers shift into the retract positions to allow them to enjoy a bowling game as with a conventional bowling game apparatus.

Since the bowling game apparatus involving in the present invention enables children to score a high point that favorably compares with non-children players even if they bowl all together on one lane, children are able to enjoy a family bowling game competing with each other in the same level without losing interest in the game.

According to the present invention, the guides are made from one of wire-like, ropelike, belt-like and rod-like members or a combination of them. If a clear or wire-like member is used for the guides, use of one too thin to see makes players believe that they get high score by their own ability even if a ball is led by the guide into just around the center of pins without falling into the gutters, because the guides are difficult for players to visually recognize. As a result, they are able to bowl with full confidence.

When the height-wise position of the second end retaining parts of the second retainers being at the guide position is lower than the upper end of a ball, the ball may contact with the second end retaining parts, resulting in damage to the retaining parts depending on their structures. In this case, it is preferable to set the height-wise position of the retaining parts being at the guide position to be higher than the upper end of the ball.

The first retainers can be configured so that their first-end retaining portions are shiftable between a first position over or near the lane and a second position apart from the lane and they shift on a first retainer drive means between the first and second positions.

When children bowl, the second end retaining parts of the second retainers can be set to previously shift into the guide position before children roll a ball, or ball detectors for detecting a ball children roll down the lane can be provided to allow a configuration in which the second end retaining parts of the second retainers shift into the guide position on the second retainer drive means and the first-end retaining portions of the first retainers shift into the first position on the first retainer drive means when the detector detects a ball. In the latter case, use of a visible member for the guides makes children feel sure that they are assisted, because players are able to visually identify the assisting operation of the guides shifting to the guide position.

The ball detectors can be configured so that their detection area longitudinally parallel the both sides of the lane and the second end retaining parts of the second retainers shift into the guide position on the second retainer drive means and the first-end retaining portions of a first retainers shift into the first position on the first retainer drive means when a ball rolls toward the sides on the lane, where the detectors detect the ball. Even children unable to control the direction of rolling a ball well are able to roll a ball toward around the center of the pins every once in a while. If the guides operate at this time, unnecessary assistance may resultantly deprives children's interest in the bowling game. Therefore, operating the guides only when a ball rolls toward the sides of the lane, or toward the gutters, allows the assistance given only when needed, preventing children from losing interest in the bowling game.

The second retainer drive means can be configured so that the guide position is adjustable to any point in widthwise direction of the lane and the guide leads a ball into the adjusted position. Such a configuration increases player's chance of getting a spare because the guide position can be set so that the ball a player rolls first is led into the so-called pocket of the pins and the ball the player rolls second is lead into un-knocked pins.

Effects of the Invention

According to the present invention provided with the configuration explained in the foregoing, children are able to enjoy a family bowling game competing each other as a full-fledged player without losing their interests in the game because children are able to score a high point that favorably compares with non-children players even if they bowl all together on one lane.

LEGEND

1: Bowling game apparatus; 2: approach; 3: lane; 4: gutter; 5: pins; 15: retainer post; 15*a*: retaining part; 20: retainer arm; 20*a*: retaining part; 45: ornament

BEST MODE FOR CARRYING OUT THE INVENTION

Figure 1:
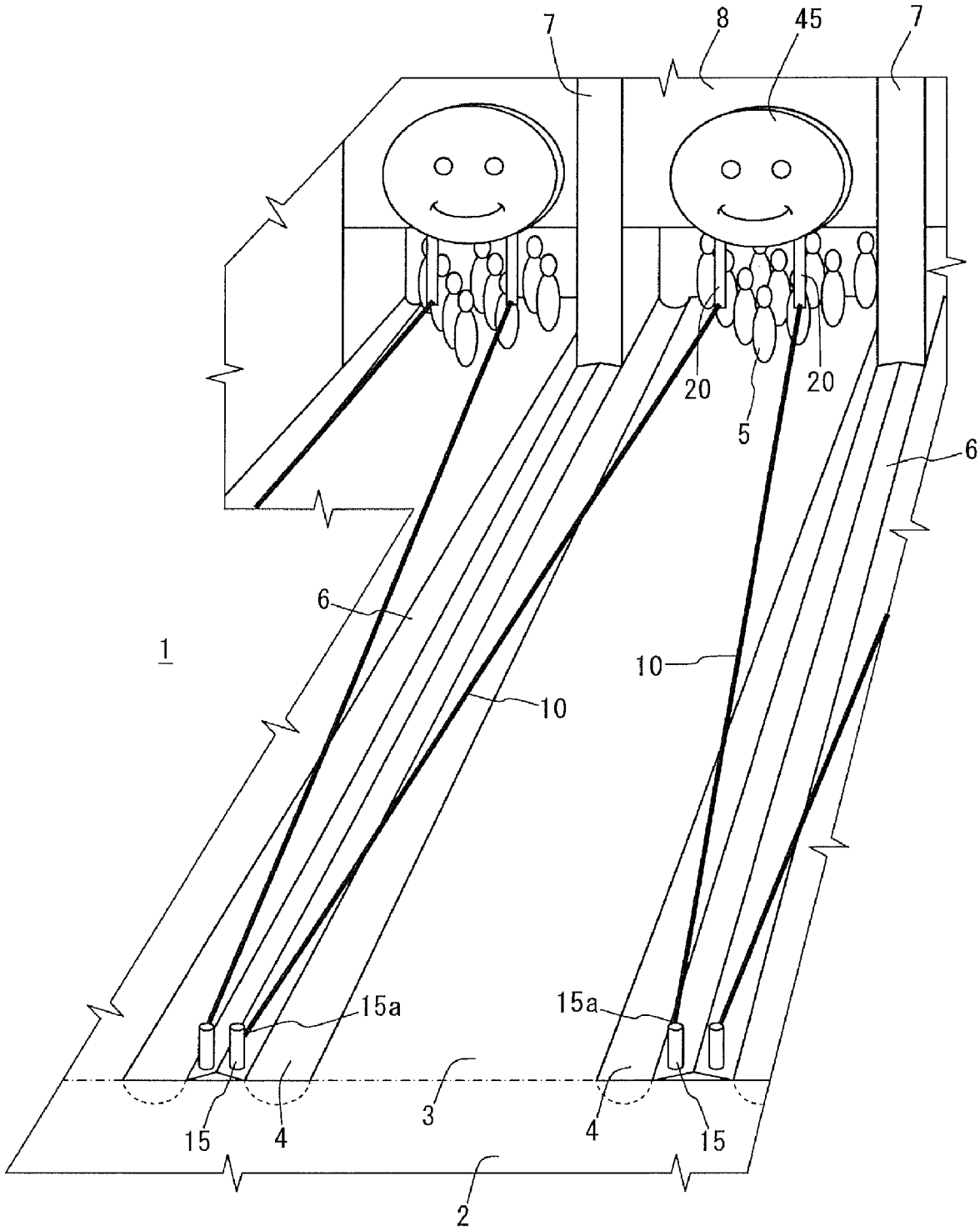
FIG. 1 shows a perspective view of a bowling apparatus in accordance with one embodiment of the present invention.
Figure 2:
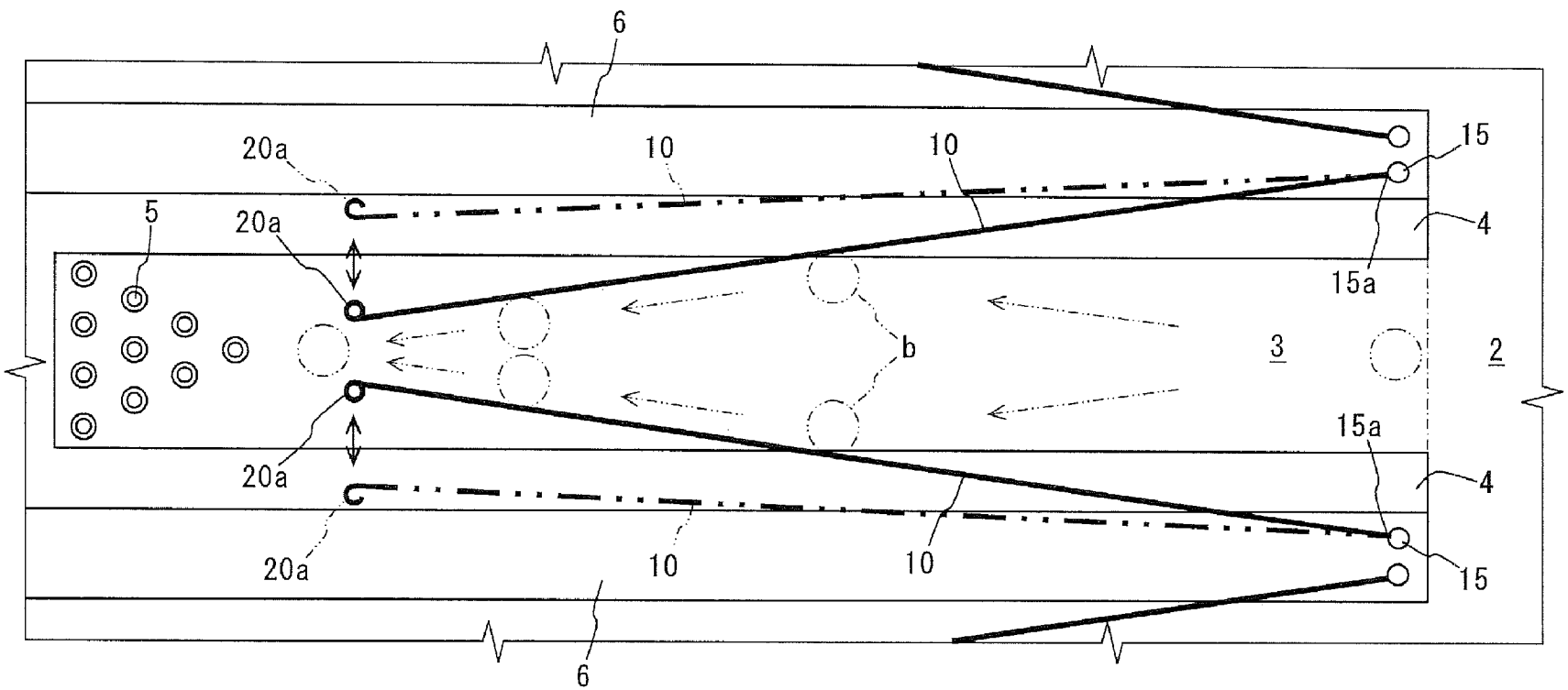
FIG. 2 shows a plan view of the bowling apparatus device shown in FIG. 1.
Figure 3:
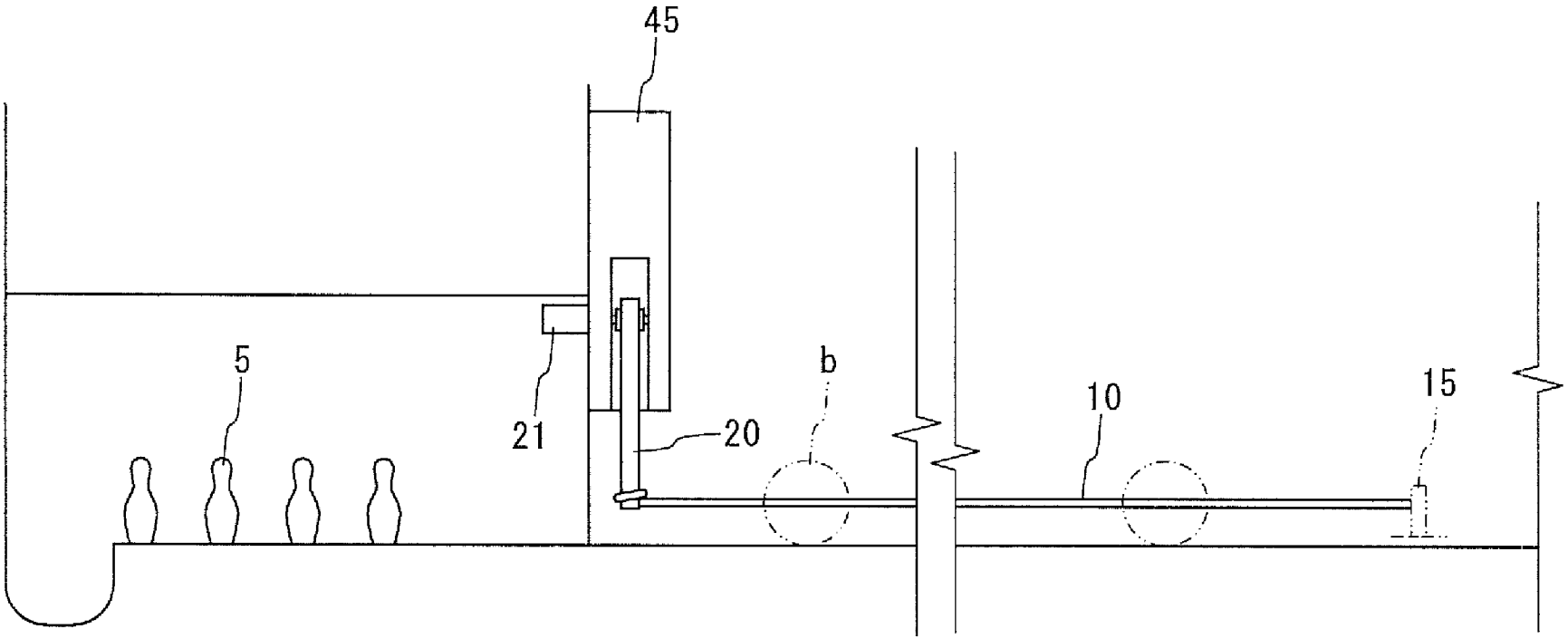
FIG. 3 shows a sectional side view of the bowling game apparatus shown in FIG. 1.
Figure 4:
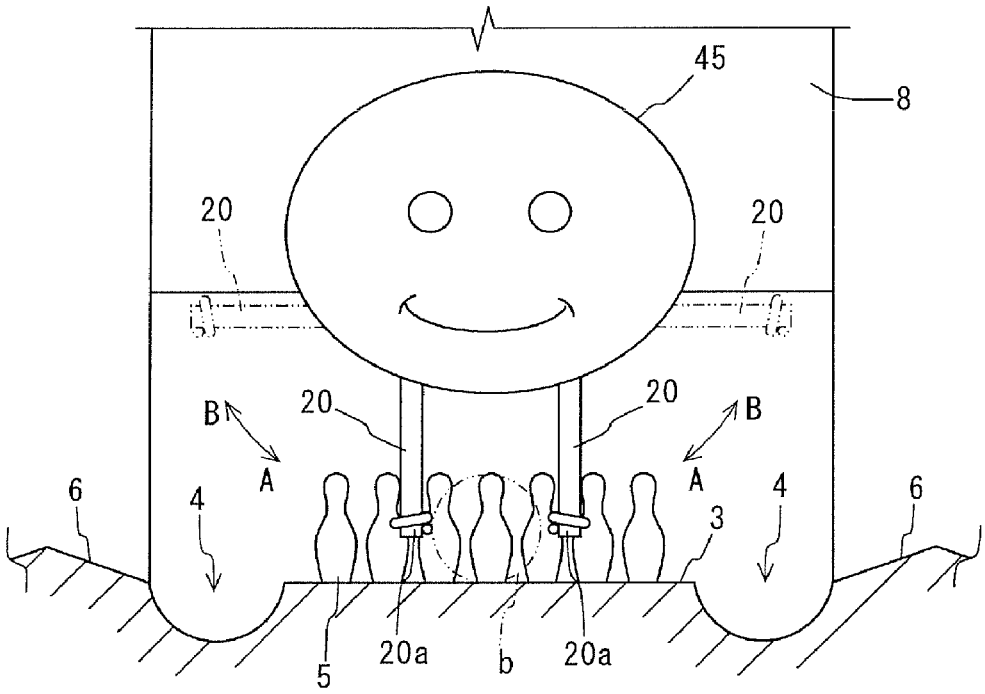
FIG. 4 shows a front view of the bowling game apparatus shown in FIG. 1.

A specified mode for carrying out the present invention is explained hereinafter with reference to the accompanying drawings. FIG. 1 shows the perspective view, FIG. 2 shows the plan view, FIG. 3 shows the sectional view and FIG. 4 shows the front view of the outlined configuration of a bowling game apparatus involving in the embodiment.

As illustrated in FIG. 1 to FIG. 4, bowling game apparatus 1 of this embodiment is provided with approach 2 where players roll ball b, lane 3 extended from approach 2 and on which ball b rolls, ten pins 5 arranged on an end of lane 3 opposite approach 2, trough-like gutters 4,4 provided on both sides of lane 3, ropelike guides 10, 10 provided longitudinally to lane 3 and made from one of synthetic fiber, natural fiber and metal (or metal fiber), retainer posts (first retainers) 15, 15 retaining first ends of guides 10, 10, retainer arms (second retainers) 20,20 retaining second ends of guides 10,10 and drive motor 21 that drives arms 20,20, and configured with adjacently placed plural sets of them.

Separator 6, which is provided between adjacent gutters 4 and 4, separates play zones configured with lane3 and gutters 4, 4. Partition wall 7, which is provided between adjacent gutters 4 and 4 near where pins 5 are placed, also separates the play zones. Front-cover 8 is provided over lane 3 between walls 7 and pins 5 are placed on lane 3 in the space partitioned by front-cover 8 and walls 7. In addition, human face ornament 45 is provided on front-cover 8.

Retainer posts 15, 15 are fixed on separation 6 lying outside a play zone and the height-wise position of retaining part 15*a* for retaining guide 10—a position where guide 10 is retained—is set to be at or around the center of ball b.

Arms 20, 20, which is pivotally suspended by ornament 45 in a plane orthogonal to lane 3, swing on drive motor 21 in the direction of arrow A-B to allow retaining part 20*a* that retains a second end of guide 10 to shift between a guide position near the widthwise center of lane 3 and a retract position apart from the guide position. A height-wise position of retaining part 20*a* being at the guide position—a position where guide 10 is retained—is set to be at or near the center of ball b as post 15. A pair of retaining parts 20*a*, 20*a* leaves a space enough for ball b to pass through when they shift to the guide position.

As illustrated in FIG. 2, when retaining parts 20*a*, 20*a* of a pair of arms 20,20 shift into the retract positions apart from each other, guides 10, 10 retained by a pair of arms 20,20 and a pair of posts 15, 15 go outside the space over lane 3 as shown by the double-dotted, dashed lines in FIG. 2. On the other hand, when retaining parts 20*a*, 20*a* shift into the guide position close to each other, guides 10, straddles gutter 3 with their first ends positioned outside a space over lane 3 and their second ends positioned at around widthwise center of lane 3.

According to bowling game apparatus 1 of this embodiment configured as explained above, when players unable to control direction of rolling a ball well like children bowl, retaining parts 20*a*, 20*a* shift on driving motor 21 into the guide position near the widthwise center of lane 3 to allows arms 20, 20 to swing in the direction of arrow A.

As a result, guide 10, 10 straddles gutter 3 with first ends positioned outside a space over lane 3 and second ends positioned at around widthwise center of lane 3, creating a guide path tapered off to the center of pins 5.

When players roll ball b with the guide path created by guide 10, 10, ball b rolls down lane 3 between guides 10, 10 toward pins 5. Even if ball b rolls toward gutters 4, 4, it contacts with guide 10, which prevents it from falling into gutter 4 before it reaches there. As a result, ball b passes through retaining parts 20*a*, 20*a* and runs into around a center of pins.

Which part of pins 5 ball b is guided into depends on the guide position. Therefore, setting the guide position at around the so-called pocket or a head of pins 5 enables children to easily get a strike.

If the space between retaining parts 20*a*, 20 being at the guide position is widened, which part of pins 5 ball b runs into is unpredictable because bowl b is not always guided toward around the pocket of pins 5. This unpredictability allows players to enjoy a thrilling game, even though it is controlled to some extent.

On the other hand, when non-children players bowl, retaining parts 20*a*, 20*a* shift into the retract position on driving motor 21 to allow arms 20, 20 to swing in the direction of arrow B. At this time, guides 10, 10 go outside the space over lane 3.

When retaining parts 20*a*, 20*a* are at the retract position, ball b directly falls into gutter 4 without being blocked even if rolling toward gutter 4. Therefore, players are able to enjoy a bowling game as with a conventional bowling game apparatus.

According to bowling game apparatus 1 of this embodiment, when children bowl, retaining parts 20*a*, 20*a* of arms 20, 20 shift into the guide position to allow guides 10, 10 to prevent ball b from falling into gutter 4 and to guide it toward around the center of pins 5 even if ball b rolls toward gutter 4. Therefore, even children unable to control the direction of rolling a ball well are inevitably allowed to knock down lots of pins 5 and to sometimes get a strike and a spear.

On the other hand, when non-children players bowl, retaining parts 20*a*, 20*a* of arms 20, 20 shift into the guide position to enable them to enjoy a bowling game as with a conventional bowling game apparatus.

Since bowling game apparatus 1 of this embodiment allows children to score a high point that favorably compares with non-children players even if they bowl all together on one lane, children are able to enjoy a family bowling game competing each other as a full-fledged player without losing interest in the game.

While one embodiment of the present invention has been explained in the foregoing, specific modes by which the present invention can be adopted is not limited to it in any way.

Figure 5:
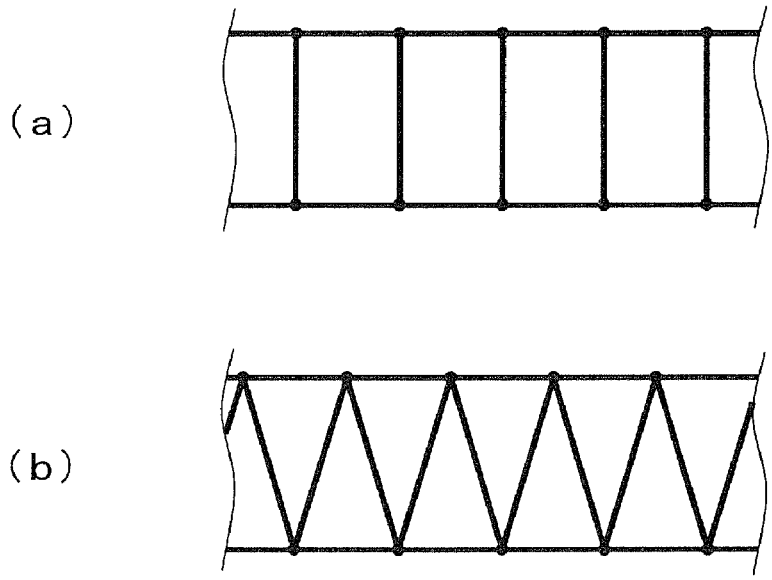
FIG. 5 shows a schematic diagram illustrating the guide member deformation examples for present embodiment.

For example, in the embodiment described above, guide10 is made from one of a ropelike member such as synthetic fiber, natural fiber and metal (or metal fiber). It can be also made from one of a wire-like member such as wire rope and piano wire, a belt-like member such as resin tape and a rod-like member such as resin, wood and metal (or metal fiber) or a combination of these members. In addition, a wire-like, ropelike and rod-like member can be used to form an object that looks like a belt as a whole as shown in FIGS. 5 (*a*) and (*b*).

Regardless of whether guide 10 is clear or opaque, if a clear or wire-like member is used for guide 10, use of one too thin to see makes players believe that they get high score by their own ability even if a ball is led by the guide toward just around the center of pins 5 without falling into gutter because guide 10 is difficult for players to visually recognize. As a result, they are able to bowl with full confidence.

In the embodiment explained above, a distance between retaining parts 20*a*, 20*a* of arms 20, 20 and retaining parts 15*a*, 15*a* of posts 15, 15 may vary during the shifting of arms 20, 20 between the retract and guide positions, unless the distance varies depending on which positions arms 20*a*, 20*a* is at. If guide 10 is inelastic, this variation must be accommodated by slacking guide 10 or bending arm 20, 20. This slacking or bending, however, may cause the unstable behavior of guide 10 or the erratic operation of arms 20, 20.

To solve this problem, it is recommended to provide a wind-in/out device for winding in and out guide 10 to arms 20, 20 and/or posts 15, 15 and to retain guide 10 with this wind-in/out device if guide 10 is elastic as a ropelike, wire-like and belt-like members. The operation of this wind-in/out device winding in and out guide 10 accommodates the variation caused by the shifting of arm 20, 20. If guide 10 is rod-like member, it is recommended to retain guide 10 with arms 20, 20 and/or posts 15, 15 shiftably in the axial direction to allow the axial shifting of guide 10 to absorb the variation.

Figure 6:
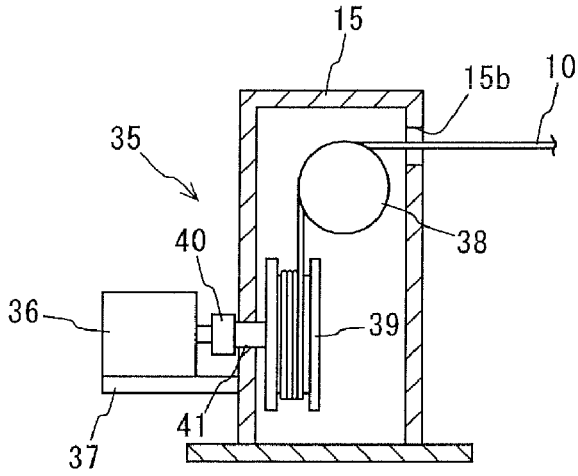
FIG. 6 shows a sectional view of a wind-in/out device for guides that can be adopted to present embodiment.

One example of the wind-in/out device is specifically illustrated in FIG. 6. Wind-in/out device 35, which is provided to post 15, comprises pulley 38 and drum 39 that are stored in hollow-body post 15, rotary shaft 41 passing through drum 39 from outside and retaining shaft 41, torque keeper 40 coupled to shaft 41, and drive motor 36 coupled to torque keeper 40. Guide 10, which end passes through-hole 15*b* formed on post 15, winds around drum 39 via pulley 38. Torque keeper 40 permits shaft 41 to rotate when the torque to be act on shaft 41 exceeds a given value.

According to winding-in/out device 30, drum 39 rotates in the wind-in direction on motor 36, which is driven when arms 20, 20 shift between the retract and guide positions. Drum 39 winds in guide 10 when the shifting of arms 20, 20 slackens guide 10 and winds out it if the torque keeper causes a slip of a junction of shaft 41 and motor 39 when the tension of guide 10 applies torque exceeding the given value to shaft 41.

According to wind-in/out device 30, when the variation occurs, winding in and out guide 10 accommodates them.

Arms 20, 20 are not limited to the configuration explained in the foregoing. FIG. 7 to FIG. 11 illustrate other modes.

Figure 7:
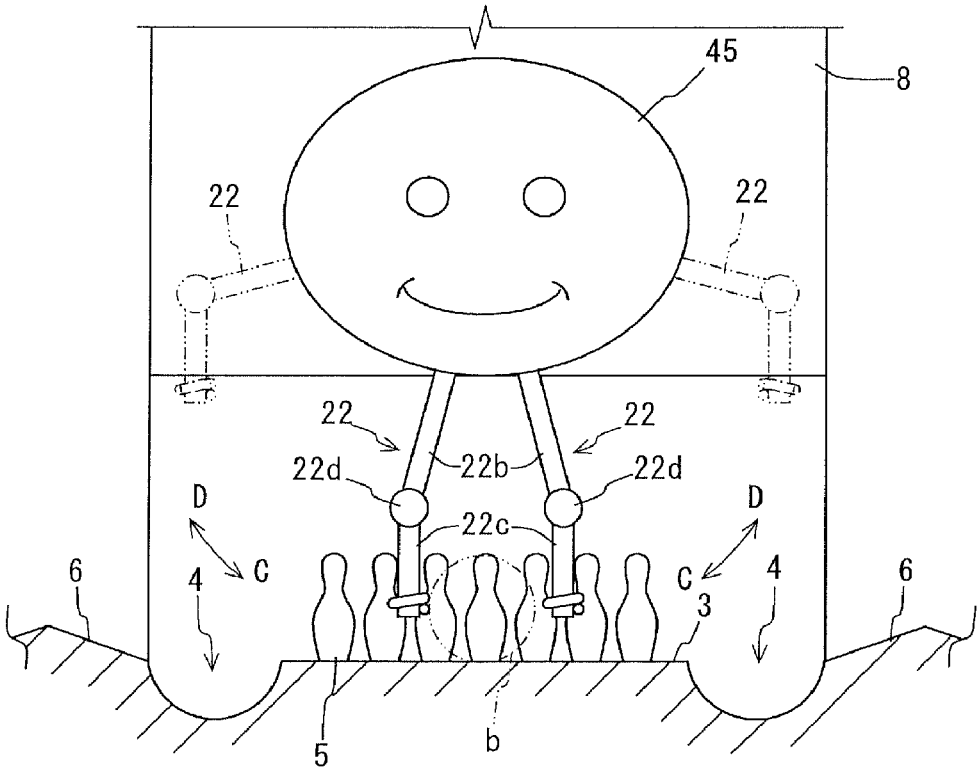
FIG. 7 shows a front view of a retaining arm in accordance with another embodiment.

Arms 22, 22 illustrated in FIG. 7 comprise first arms 22*b*, 22*b* and second arms 22*c*, 22*c* whose ends are coupled by joints 22*d*, 22*d*. Since first arms 22*b*, 22*b* swing on motor 21 as illustrated and second arms 22*c*, 22*c* swing on a drive motor built in joints 21*d*, 21*d* (not illustrated), arms 22, 22 resultantly shift in the direction of arrow C-D between the positions shown by the double-dotted, dashed line and the solid line.

Figure 8:
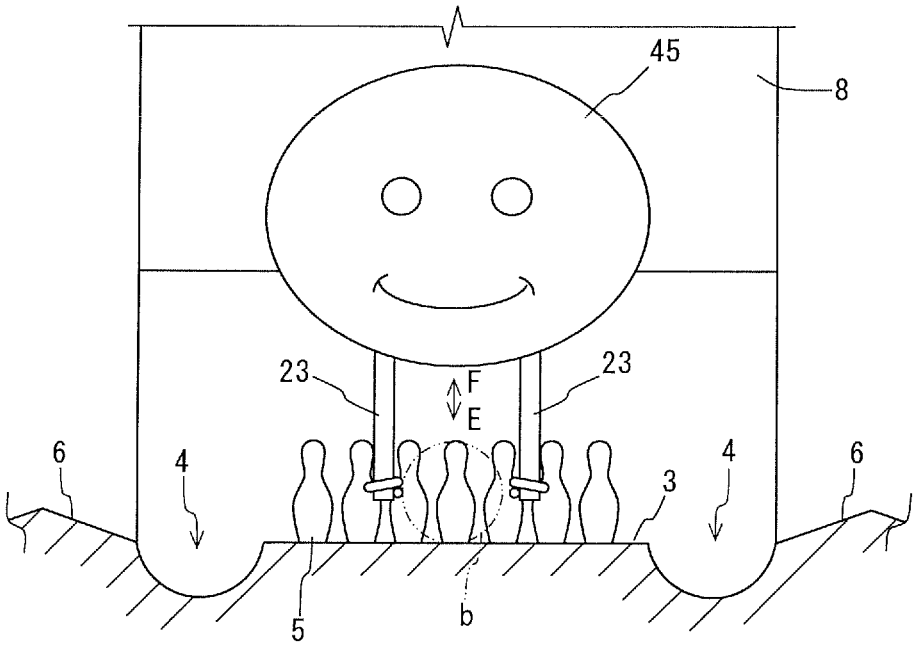
FIG. 8 shows a front view of a retaining arm in accordance with another embodiment.

Retaining arms 23, 23 illustrated in FIG. 8 are shiftably provided in the direction of arrow E-F (the direction of up-and-down) on drive mechanism comprising a fluid pressure cylinder, a drive motor, a ball screw and nut.

Figure 9:
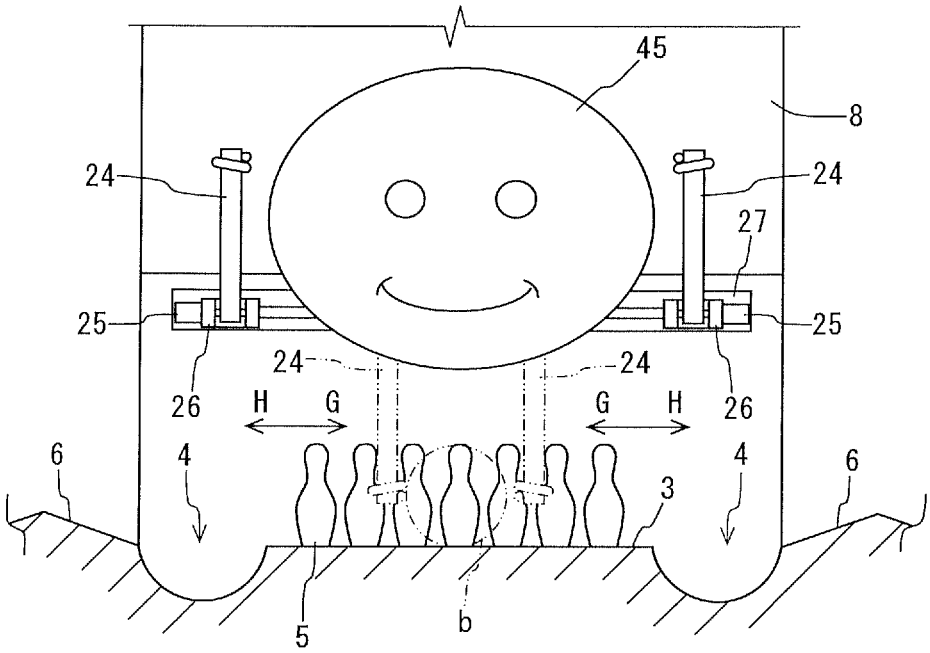
FIG. 9 shows a front view of a retaining arm in accordance with another embodiment.
Figure 10:
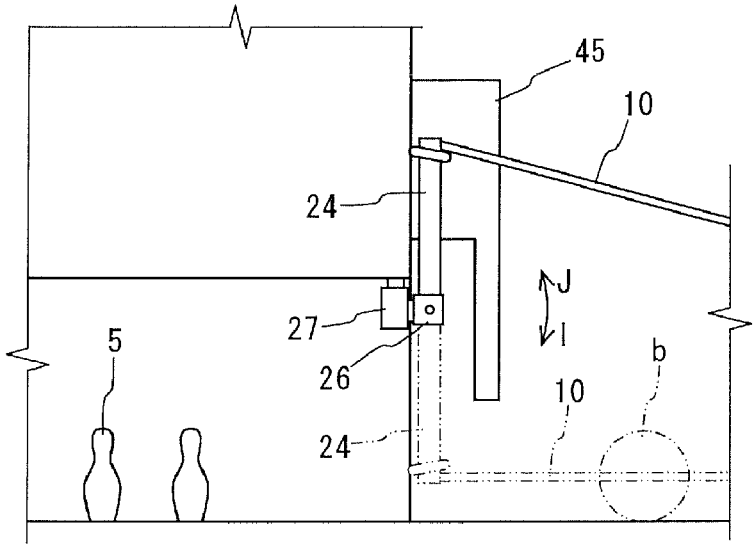
FIG. 10 shows a front view of a retaining arm in accordance with another embodiment.

Arms 24, 24 illustrated in FIG. 9 and FIG. 10, which are pivotally retained by brackets 26, 26, swing on drive motor 25, 25 in the direction of arrow I-J. Brackets 26, 26 shift in the direction of arrow G-H—the direction in which they come close and off—on a drive mechanism comprising, for example a drive motor, ball screw and nut. Therefore, arms 24, 24 shift between the position shown by the solid line, from where they swing in the direction of arrow I and slide in the direction of arrow G, and the position shown by double-dotted, dashed line, into where they slide.

Figure 11:
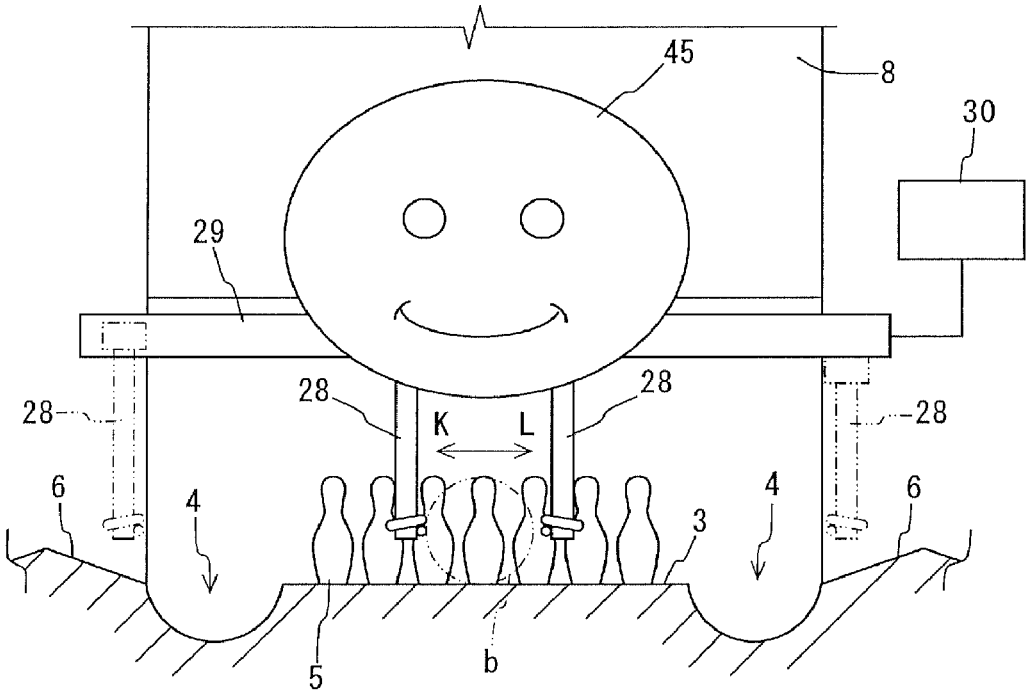
FIG. 11 shows a front view of a retaining arm in accordance with another embodiment.

Retainer arms 28, 28 illustrated in FIG. 11 is configured to independently shift on drive mechanism 29 in the direction of arrow K-L (the widthwise direction of lane 3). First and second retainer arms 28, 28 are shiftably retained in the direction of arrow K-L respectively on the front side and under side of driving mechanism 29, which is controlled by controller 30 to allow arms 28, 28 to shift into any given position in the width direction of lane 3 (the direction of arrow K-L).

In this configuration, the guide position can be set to any point. Therefore, for example, setting the guide position to where ball b is guided toward the so-called pocket of pins 5 when a player rolls first and to where it is guided toward un-knocked pins when the player rolls second increases player's chance of getting a spear.

Figure 12:
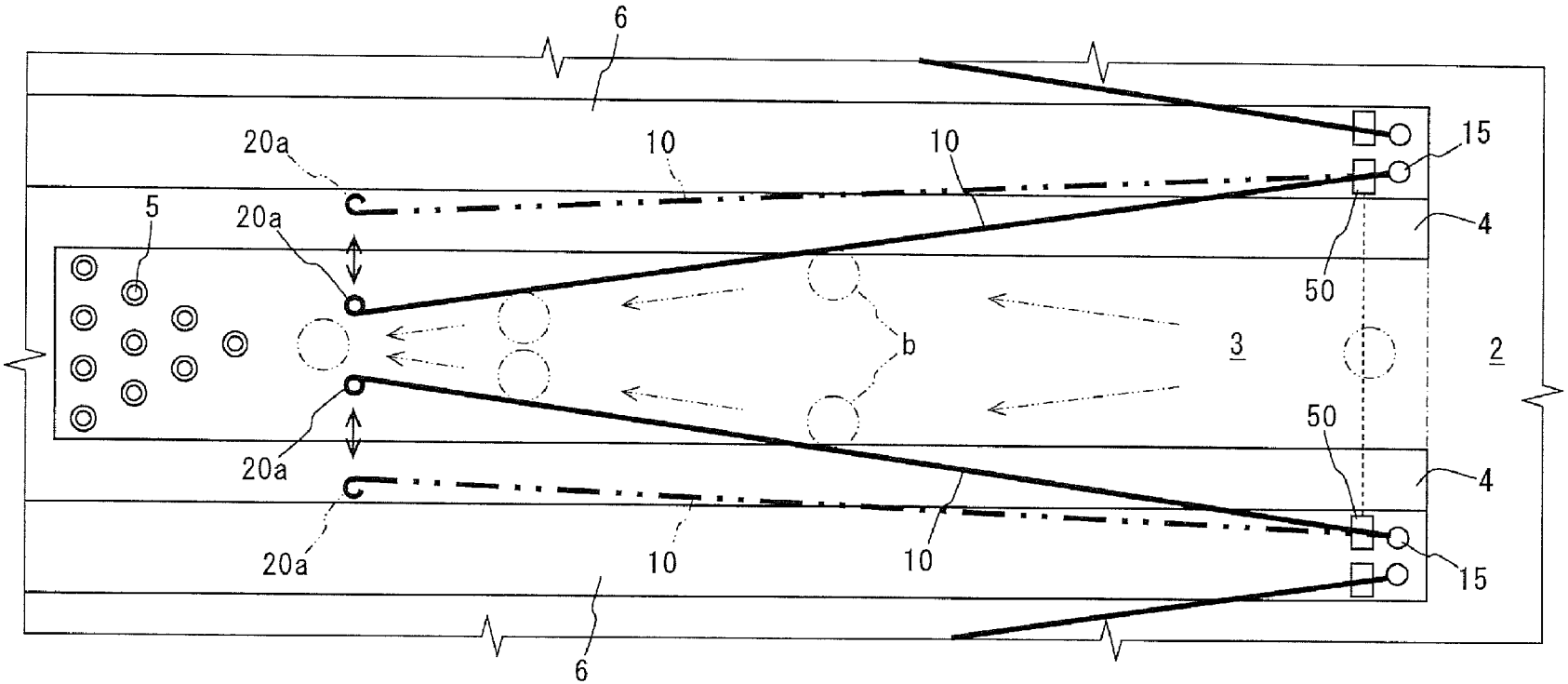
FIG. 12 shows a plan view of a bowling game apparatus in accordance with another embodiment.

In the embodiment explained in the foregoing, retaining parts 20*a*, 20*a* of arms 20, 20 previously shift to the guide position when children bowl. Besides, as illustrated FIG. 12, a pair of light-emitting-receiving detectors 50, 50 for detecting ball b rolled down lane 3 can be provided on separation 6 near approach 2 to allow retaining parts 20*a*, 20*a* to shift on driving motor 21 into the guide position when detectors 50, 50 detect ball b. In this case, for example, if guide 10 is a visible member, children feel like they are assisted by a personified object combined with human face ornament 45 because players are able to visually identify the assisting operation of guide 10 shifting into the guide position.

Figure 13:
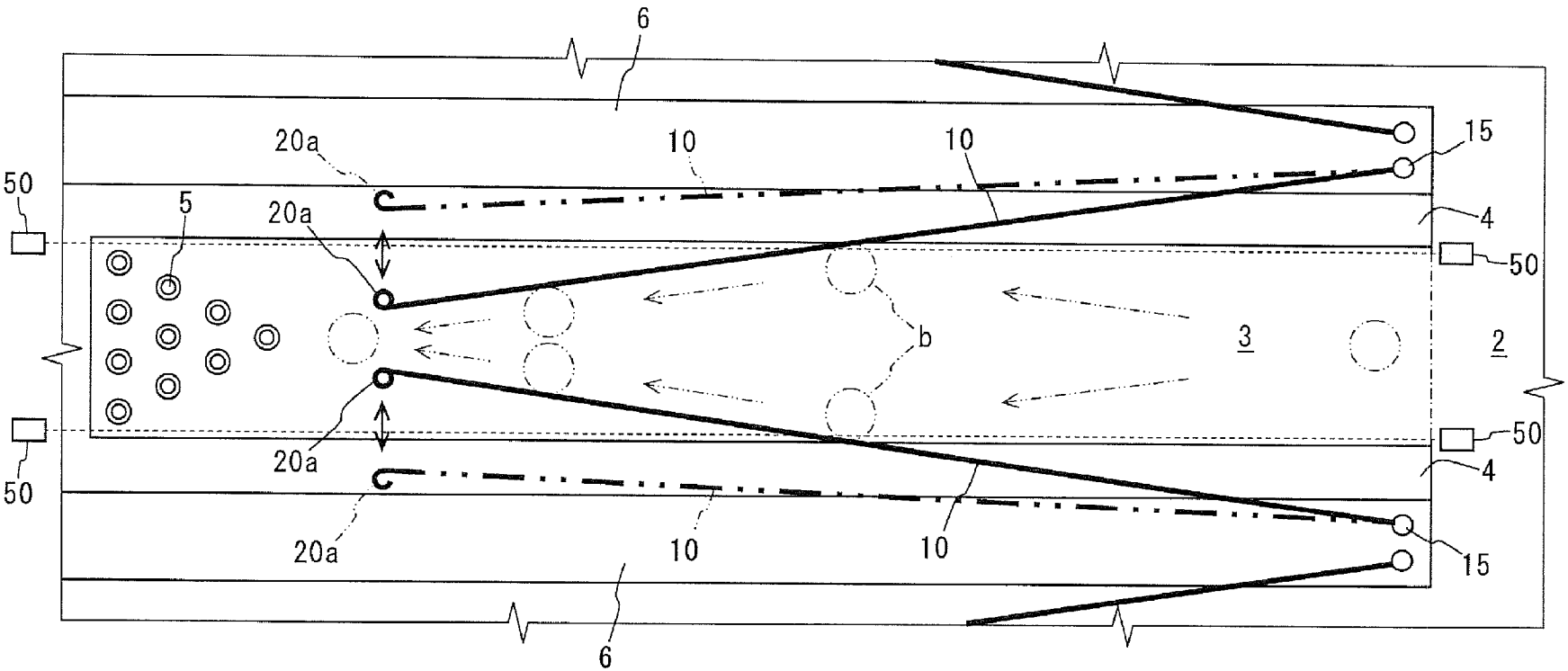
FIG. 13 shows a plan view of a bowling game apparatus in accordance with another embodiment.

As illustrated in FIG. 13, bowling game device1 can configured so that two pairs of detectors 50, 50 are placed respectively near approach 2 and behind pins 5 so as to have longitudinal detection areas on the both sides of lane 3 and retaining parts 20*a*, 20*a* shift into the guide position when ball b rolls toward the sides of lane 3, where detectors 50, 50 detect it.

Even children unable to control direction of rolling a ball are able to roll a ball toward around the center of pins5 every once in a while. If guides 10, 10 operate at this time, unnecessary assistance may deprive children's interest in the game resultantly. If guide 10, 10 operate only when ball b rolls toward the sides of lane 3, or toward gutter 4, assistance given only when needed prevents children from losing interest in the game.

Figure 14:
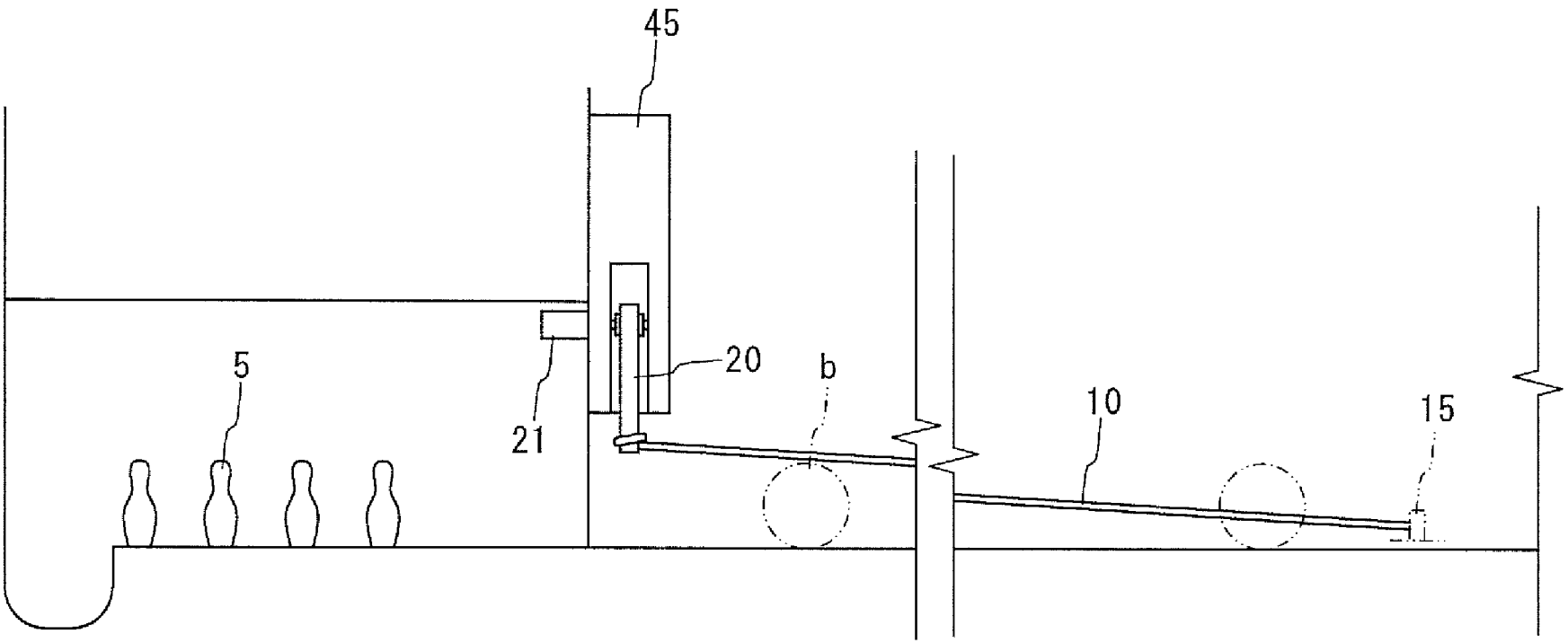
FIG. 14 shows a side view of a bowling game apparatus in accordance with another embodiment.

As illustrated in FIG. 14, the height-wise position of retaining parts 20*a*, 20*a* of arms 20, 20 being at the guide position can be set to be higher than the upper end of ball b. If it is lower than the upper end of ball b, ball b may contact with arms 20, 20 when running through, causing damage to arm 20, 20. This damage, however, can be avoided by setting the height-wise position of retaining parts 20*a*, 20*a* to be higher than that of upper end of ball b to prevent it from contacting with arms 20, 20.

Figure 15:
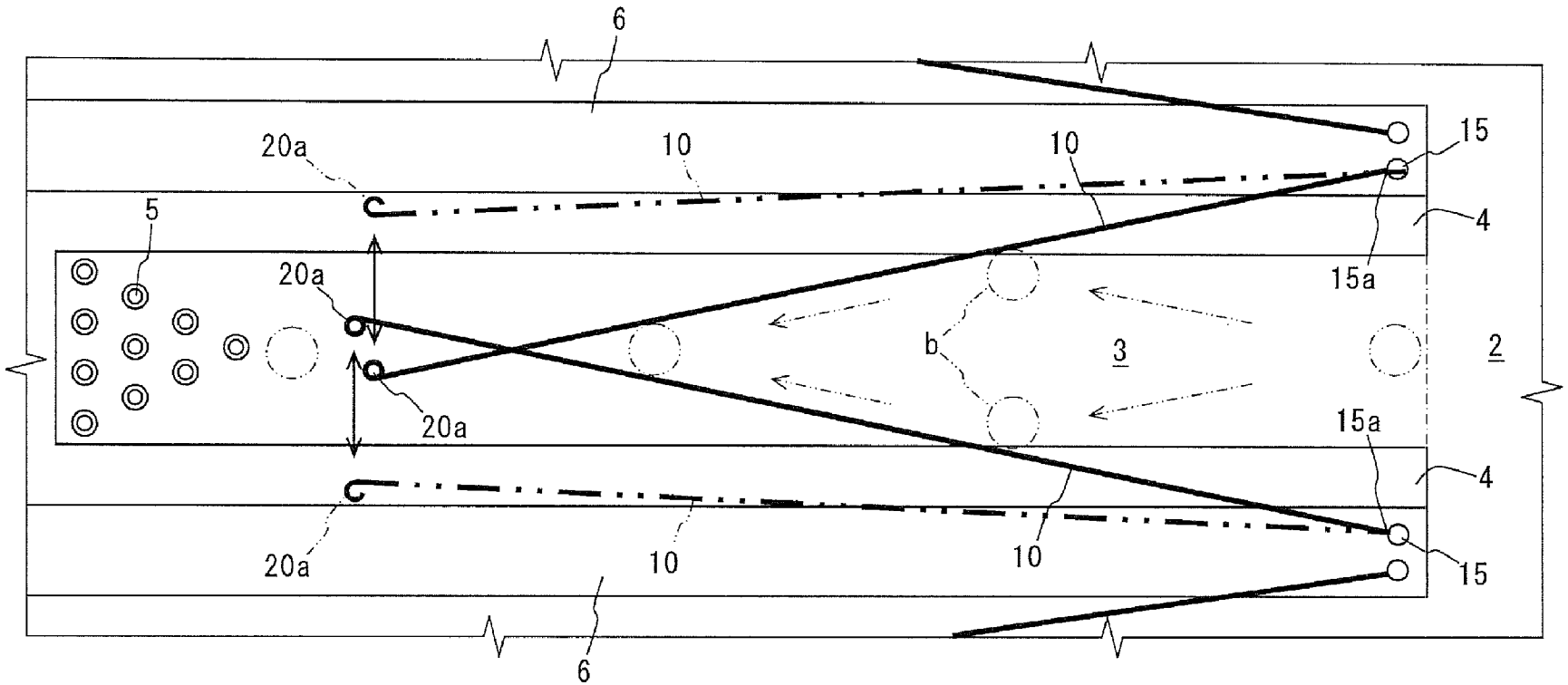
FIG. 15 shows a plan view of a bowling game apparatus in accordance with another embodiment.

In this case, the position of arms 20, 20 being at guide position is not limited to the example explained in the foregoing. For example, as illustrated in FIG. 15, the position can be set to where arms 20, 20 further shift through the center of lane 3 into the opposite side until guides 10, 10 intersect on a plane.

Figure 16:
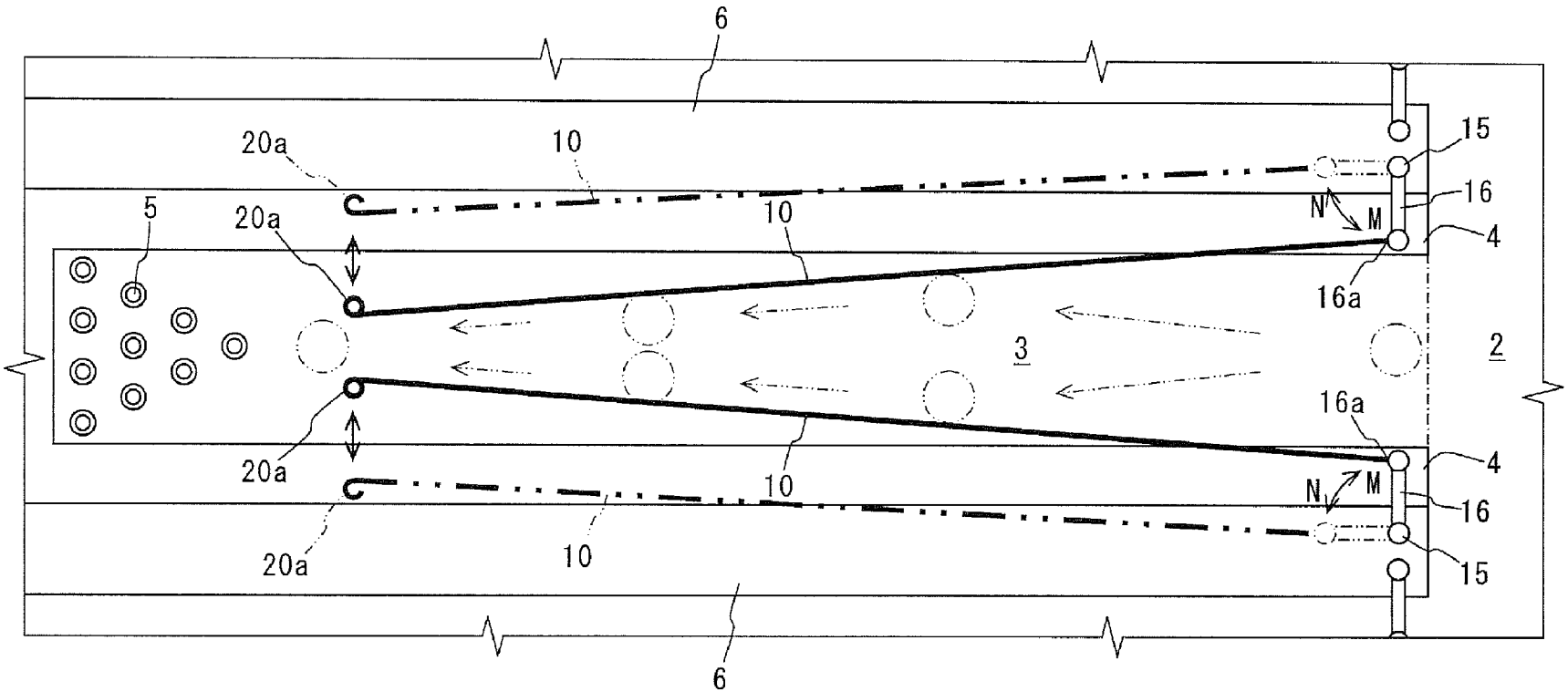
FIG. 16 shows a plan view of a bowling game apparatus in accordance with another embodiment.

As illustrated in FIG. 16, posts 15, 15 can pivotally provided in the direction of arrow M-N and configured so that arm 16 fixed on outer surface of posts 15, 15 retains first ends of guide 10, 10 and rotates in the direction of arrow M simultaneously with arms 20, 20 sifting into the guide position to allow the first ends of guides 10, 10 to shift into the position over or near lane 3. This can more securely prevent ball b rolled by players from falling into gutters because the first ends of guides 10, 10 go over or near lane.

In this case, posts 15, 15 can be rotated in the direction of arrow M to allow the first ends of guides 10, 10 to shift into the position over or near lane 3 when detector 50, 50 detects ball b.

As explained in the foregoing, the present invention can be adopted preferably to a bowling game apparatus for enjoying a game of rolling a ball and trying to knock down as many of pins as possible that are arranged and placed on a lane with the ball.

The invention claimed is:

1. A bowling game apparatus utilizing a bowling ball, the bowling game apparatus comprising:

an approach area where a player carries out bowling actions;

a lane extending from said approach area and on which the bowling ball bowled by the player rolls;

a plurality of pins arranged and placed on an end of said lane opposite said approach area;

two guides provided longitudinally along the lane, the guides including at least one of a wire, a rope, a belt and a rod;

two first retainers each including a first end retaining portion which retains a first end of one of said guides, said two first retainers being disposed on both outer sides of an approach side of said lane;

two second retainers each including a second end retaining portion which retains a second end of one of said guides, said two second retainers being disposed above the lane at a position between said two first retainers and said plurality of pins, said second end retaining portions of said two second retainers being shiftable between (i) a guide position which is above the lane and between the plurality of pins and the approach, and (ii) a retract position away from the guide position; and a second retainer drive means for causing the second end retaining portions of said second retainers to shift between the retract position and the guide position;

wherein when said second end retaining portions are in said guide position, axes of said guides intersect diagonally as viewed from overhead, such that said guides can contact a height-wise central position of the bowling ball so as to lead the bowling ball towards a middle position of the plurality of pins.

2. The bowling game apparatus of claim 1, further comprising a bowling ball detector for detecting the bowling ball rolling down the lane, wherein when the bowling ball is detected by said bowling ball detector, said second retainer drive means shifts the second end retaining portions of said second retainers from the retract position to the guide position.

3. The bowling game apparatus of claim 2, wherein said bowling ball detector has longitudinal detection areas paralleling both sides of the lane, and wherein when bowling ball rolls toward either side of the lane and is detected by said bowling ball detector, said second retainer drive means shifts the second end retaining portions of said second retainers from the retract position to the guide position.

4. The bowling game apparatus of claim 1, wherein when the second end retaining portions are in the guide position, a height-wise location of the second end retaining portions of said second retainers is in a position higher than a height-wise location the first end retaining portions of said first retainers and higher than an upper end of the bowling ball.

5. The bowling game apparatus of claim 1, wherein first end retaining portions of said first retainers are shiftable between (i) a first position which is either a location above the lane or a location adjoining the lane, and (ii) a second position in a location separated from the lane, and wherein a first retainer drive means shifts the first end retaining portions between the first position and the second position.

6. The bowling game apparatus of claim 5, further comprising a bowling ball detector for detecting the bowling ball rolling down the lane, wherein when the bowling ball is detected by said bowling ball detector, said first retainer drive means shifts the first end retaining portions of said first retainers from the second position to the first position, and said second retainer drive means shifts the second end retaining portions of said second retainers from the retract position to the guide position.

7. The bowling game apparatus of claim 6, wherein said bowling ball detector has longitudinal detection areas paralleling both sides of the lane, and wherein when the bowling ball rolls toward either side of the lane and is detected by said bowling ball detector, said first retainer drive means shifts the first end retaining portions of said first retainers from the second position to the first position, and said second retainer drive means shifts the second end retaining portions of said second retainers from the retract position to the guide position.

8. The bowling game apparatus of claim 5, wherein when the second end retaining portions are in the guide position, a height-wise location of the second end retaining portions of the second retainers is at a position higher than a height-wise location the first end retaining portions of said first retainers and higher than an upper end of the bowling ball.

9. The bowling game apparatus of claim 1, wherein said guide position of said second end retaining portions is movable to any position along the lane widthwise, so as to lead the bowling ball to a position other than the middle portion of the plurality of pins.

10. The bowling game apparatus of claim 2, wherein said guide position of said second end retaining portions is movable to any position along the lane widthwise, so as to lead the bowling ball to a position other than the middle portion of the plurality of pins.

11. The bowling game apparatus of claim 3, wherein said guide position of said second end retaining portions is movable to any position along the lane widthwise, so as to lead the bowling ball to a position other than the middle portion of the plurality of pins.

12. The bowling game apparatus of claim 4, wherein said guide position of said second end retaining portions is movable to any position along the lane widthwise, so as to lead the bowling ball to a position other than the middle portion of the plurality of pins.

13. The bowling game apparatus of claim 5, wherein said guide position of said second end retaining portions is movable to any position along the lane widthwise, so as to lead the bowling ball to a position other than the middle portion of the plurality of pins.

14. The bowling game apparatus of claim 6, wherein said guide position of said second end retaining portions is movable to any position along the lane widthwise, so as to lead the bowling ball to a position other than the middle portion of the plurality of pins.

15. The bowling game apparatus of claim 7, wherein said guide position of said second end retaining portions is movable to any position along the lane widthwise, so as to lead the bowling ball to a position other than the middle portion of the plurality of pins.

16. The bowling game apparatus of claim 8, wherein said guide position of said second end retaining portions is movable to any position along the lane widthwise, so as to lead the bowling ball to a position other than the middle portion of the plurality of pins.

* * * * *